United States Patent [19]

Carr

[11] 4,018,248

[45] Apr. 19, 1977

[54] VALVE

[76] Inventor: Charles E. Carr, P.O. Box 419, Lawrenceville, Ill. 62439

[22] Filed: July 25, 1975

[21] Appl. No.: 598,762

Related U.S. Application Data

[63] Continuation-in-part of Ser. No. 504,167, Sept. 9, 1974, abandoned.

[52] U.S. Cl. ..... 137/514.3; 137/514.5; 417/553

[51] Int. Cl.[2] ..... F16K 21/10; F04B 21/04

[58] Field of Search ..... 417/552, 430, 553; 137/514, 514.3, 514.5

[56] References Cited

UNITED STATES PATENTS

| | | | |
|---|---|---|---|
| 1,610,869 | 12/1926 | Loranger et al. | 137/514.3 |
| 2,091,138 | 8/1937 | Crall | 137/514 |
| 2,094,951 | 10/1937 | Rowan | 137/514.3 |
| 2,318,962 | 5/1943 | Parker | 137/514.5 |
| 2,643,090 | 6/1953 | Cluphf | 417/552 |
| 3,054,420 | 9/1962 | Williams | 137/514.3 |
| 3,175,758 | 3/1965 | Dirk | 417/566 |
| 3,244,112 | 4/1966 | Parkin | 417/430 |
| 3,697,199 | 10/1972 | Spears | 417/430 |

FOREIGN PATENTS OR APPLICATIONS

| | | | |
|---|---|---|---|
| 640,015 | 4/1962 | Canada | 137/514.3 |
| 577,825 | 6/1946 | United Kingdom | 137/514 |

*Primary Examiner*—William L. Freeh
*Attorney, Agent, or Firm*—Jack E. Dominik

[57] ABSTRACT

A valve is disclosed, which provides its principal utility in oil field pumping operations, having a valve body with an interior quiet chamber. Ports are provided beneath the chamber, shown as holes in the side wall of the valve body. A pin extends downwardly in the quiet chamber, and a valve is provided having a long stem with a hollow bore proportioned for a sliding fit along the aligning pin, the valve terminating in a head having a seating portion. A seat is provided in the lower portion of the valve in open communication with a lower extension. In an alternative embodiment, a second seat is provided at a mid portion of the valve to mate with a chamfered seat in the lower portion of the quiet chamber. In addition, a stainless steel insert is provided on the face of the lower valve seat. The valve is preferably formed of a light weight, non-corrosive, relatively inert moldable plastic, such as that known as delrin. Optionally, a spring may be provided in coaxial biased relationship between the valve head and the upper portion of the body to urge the valve into a closed condition.

20 Claims, 9 Drawing Figures

FIG. 4
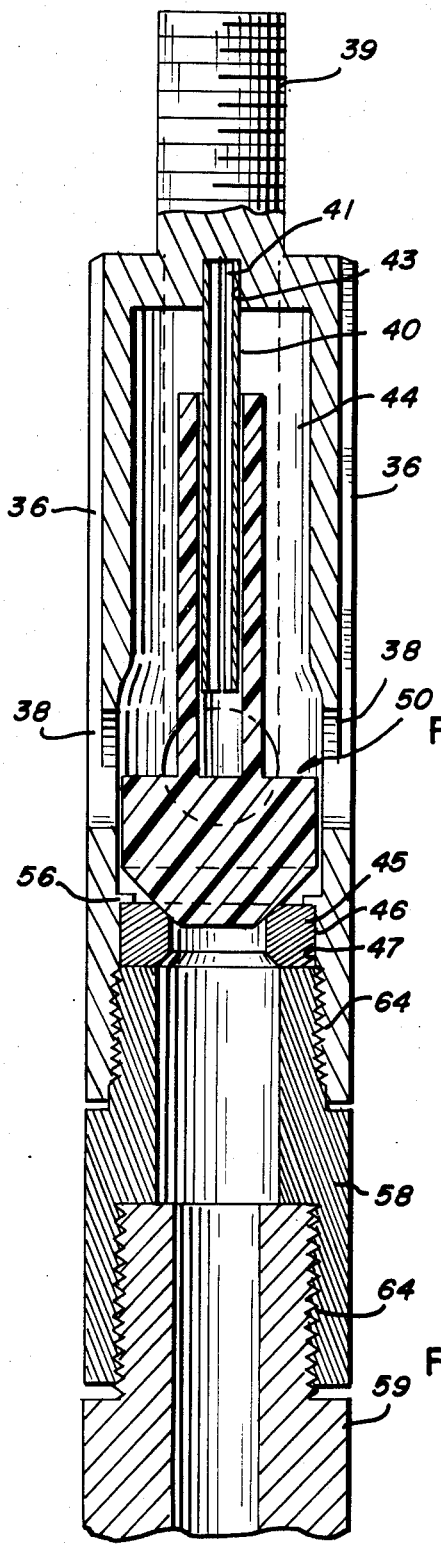
FIG. 6
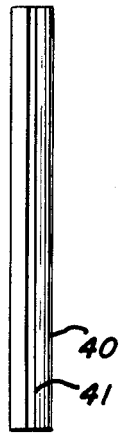
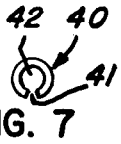
FIG. 7
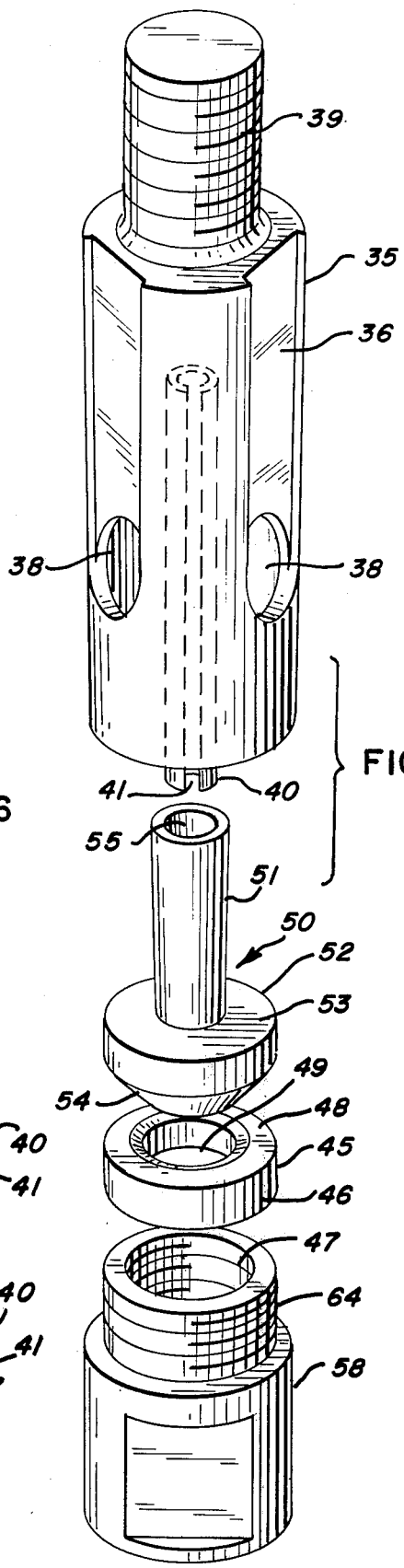
FIG. 5

VALVE

RELATED APPLICATIONS

This application constitutes a continuation-in-part of earlier filed and co-pending application Ser. No. 504,167 filed Sept. 9, 1974, now abandoned.

BACKGROUND OF THE INVENTION

1. Field of the Invention

The field of the invention relates to valves in general, and more particularly to the type of valve that may readily be employed with a traveling and standing valve combination with an oil pump. Also, the valve can be employed as a check valve in similar pumping operations. Many of the valves relating to this particular purpose are classified in Patent Office Class 417, various sub classes.

2. Description of Prior Art:

One exemplary disclosure is the Clinger U.S. Pat. No. 680,565 which discloses a centrally located valve guide pin in a cage, but the fluid travels through the upper portion of the cage. Such a valve construction is vulnerable to failure due to the lack pf protection from particles suspended in produced fluid which will foul the guide stem and cause seizure in the annular space around the valve and valve stem. Conrader U.S. Pat. No. 1,067,315 discloses a valve guided by a square stem terminating in a threaded portion. It is also vulnerable to particles which may fall from the interior of the tubing. In addition, particles of sand of gyp in the stream of produced fluids can also bind the squared stem to its valve aligning means, thereby causing failure. Anothr relevant patent is the Pippin U.S. Pat. No. 1,923,040 disclosuring an internally guided pin, but it does not guide the valve responsive to obtain the proper centering. Furthermore, no mreans is provided for shielding the alignment pin from abrading particles of gyp, sand grains, and the like. Additional patents in the same general field are U.S. Pat. Nos. 1,900,731; 1,469,106; and 3,510,234. Uniformly lacking in these prior patents and other commerical devices is a construction which takes advantage of the inherent separation of oil and water, with the oil being in the upper portion of the formation. Quite obviously, this oil is available, if properly entrapped and utilized, to shield against corrosion and at the same time to lubricate and to assist in repelling particles of gyp and sand from clogging the valve. The typical prior art is shown in FIG. 2 of the drawings to be described hereinafter, which is a ball cage type valve. In such valves, a steel ball migrates within a cage and seats on a seat ring to close the valve. In such operations the mass of the steel ball is significant, and the hammering which takes place within the cage and the ring sat is an inherently self-destructing combination.

SUMMARY OF THE INVENTION

The present invention stems from the recognition that oil and water will separate, oil rising to a higher level and may thereby be entrapped in a quiet chamber of a valve surrounding a pin which serves to align the hollow bored stem of a valve terminating at its lower portion in a head, the latter being adapted for coacting engagement with a ring seal at a lower portion of the valve body. A seat is optionally provided at a mid-portion of the valve and engages a chamfered seat interiorly of the valve body and seals off the quiet chamber to prevent contaminants from circulating therein during fluid discharge, and also to assist in aligning the valve for return to its seated position with the ring seat. Ports are provided in the periphery of the valve body to pass fluid outwardly when the valve moves upwardly along the aligning pin. The aligning pin is provided with a hollow interior, and a bypass port to permit fluids compressed within the hollow stem of the valve to pass outwardly into the quiet chamber. Optionally, a spring may be provided in coaxial biased relationship with the valve stem to urge the same into the closed configuration. Desirably, the path of the fluid passing out the ports is blocked from passing upwardly into the quiet chamber, but if such does penetrate the quiet chamber, the oil portion will separate upwardly and shield the stem and aligning pin contaminants, and also constantly lubricate the same and protect the same against corrosion if the valve is inoperative in a downhole configration for some period of time.

In view of the foregoing, it is one of the primary objects of the present invention to provide a valve with an inverted quiet chamber which will fill itself with oil, and thus avoid the contaminants which are normally formed within the water phase of produced fluids, such as gyp, known as calcium carbonate, or barium sulphates, as well as sand within the well.

Still another object of the present invention is to provide a valve with a very light weight plastic moving part which avoids the hammering and destruction to cage type valves as presently used in oil field applications. A further advantage of the particular configuration of the present valve is that it can be removed, simply placed in a drill press of even a hand drill, and the seating portion refaced. The only other parts having any conceivable wear are the seat, and the aligning pin, which can be readily replaced, thereby giving the valve an almost perpetual life with the exception of a few parts which can be readily interchanged.

Still another object of the present invention is to provide a valve with an inverted quiet chamber in which oil will collect; and because the contaminants known as gyp are heavier than the oil, any which may migrate into the quiet chamber will settle out in the course of time and other activity.

Another object of the present invention is to provide a second valve seat which seals off the quiet chamber while fluid is being bypassed thereby minimizing the likeihood of contaminants such as gyp passing into the quiet chamber during fluid flow, and preserving the lubrication between the pin and the moving valve.

A related object is to provide a hardened lower seat which is snap-fittingly engaged to the poppet portion of the valve and matingly engages the main seat of the valve body.

Yet a further important object of the present invention is to provide a valve with the foregoing objectives in mind which is relatively inexpensive to produce, and because its body portion may be made of stainless steel, and the valve portion of delrin, it will have a very long useful life.

ILLUSTRATIVE DRAWINGS

Further objects and advantages of the present invention will become apparent as the following description of an illustrative embodiment takes place, accompanied by the drawings in which:

FIG. 4 is an enlarged sectional view of the traveling valve at the upper portion of FIG. 1.

FIG. 5 is an exploded perspective partially diagrammatic view of the principal elements of the subject valve, and although shown as a traveling valve, the interior elements are substantially the same as the standing valve.

FIG. 6 is a front elevation of the aligning pin.

FIG. 7 is an end view of the aligning pin.

DESCRIPTION OF FIRST EMBODIMENT

Figure 1:
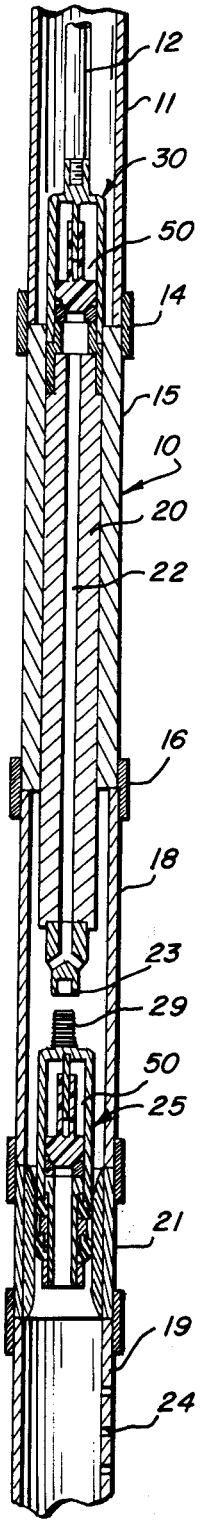
FIG. 1 is a longitudinal sectional view of a pump in a downhole configuration showing a traveling valve at the upper portion and a standing valve at the lower portion in a typical oil field environment.

A typical down hole oil well pump 10 utilizing valves illustrative of the present invention is shown in FIG. 1. There it will be seen that the pump is at the lower portion of a string of tubing 11 and contains a string of interior rods 12 for actuating the plunger 20 up to pump 10. A collar 14 is threaded to the tubing 11 at its lower portion, and connects the same to the barrel 15 which houses the plunger 20. A lower collar 16 is similarly threaded to the lower portion of the barrel 15 connecting the same to the barrel extension 18. The seating assembly 21 is provided with a lower threaded portion which engages the anchor 19, the lower portion of the entire pump assembly 10.

In operation the rods 12 are reciprocated upwardly and downwardly which in turn reciprocate the plunger 20. The standing valve 25 at the lower portion of the pump 10 admits fluids which pass through perforations 24 or other gathering elements of the anchor 19, into the interior portion of the barrel extension 18. The hollow bore 22 of the plunger 20 then transmits the fluid upwardly to the traveling valve 30 which bypasses the fluid under pressure and drives the same upwardly through the tubing 11. It will be appreciated that upon each stroke of the rods 12, one or the other of the standing valve 25 or the traveling valve 30 will be alternatively opened. Removal for servicing is accomplished by pulling the rods 12 out of the string of tubing 11, thereby raising the traveling valve 30 and its associated plunger 20. To remove the standing valve 25, the catcher 23 is lowered until comes in contact with the catcher adapter 29 on the standing valve 25, the same is engaged, and thereafter lifted out by lifting the sucker rod string which disengages the standing valve 25 from the seating nipple.

Figure 2:
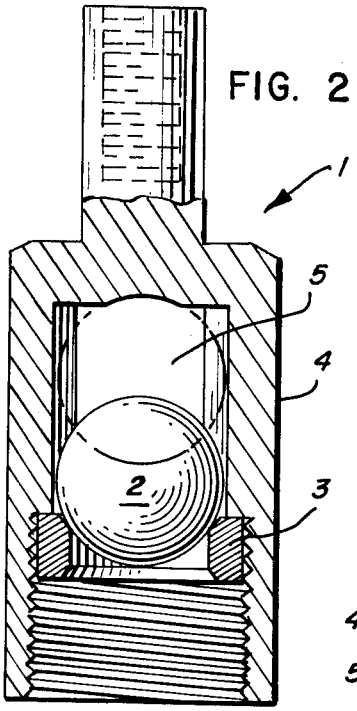
FIG. 2 is a longitudinal sectional view of a typical prior art ball cage type valve in which a steel ball is seated on a ball seat.

The typical prior art type valve employed as either a standng valve 25 or traveling valve 30 is shown in FIG. 2 as a ball cage valve 1. Such a unit has a large steel ball 2 positioned on top of a seat 3 in a valve cage 4. The valve cage 4 has a plurality of bypass slots or cage slots 5 as shown. In operation, as the ball cage valve 1 is reciprocated, fluid passed beneath the ball and in effect floats the ball upwardly and passes between the ball and the ring seat 3. A steel ball 2 of the character shown may weigh upwardly of one pound. When it is appreciated that the standard formula for monemtum is $\frac{1}{2}MV^2$, quite obviously if the mass can be reduced to a matter of an ounce or two, the momentum of the valve can be significantly reduced and its tendency to self-destruct due to hammering in operation can be minimized.

Figure 3:
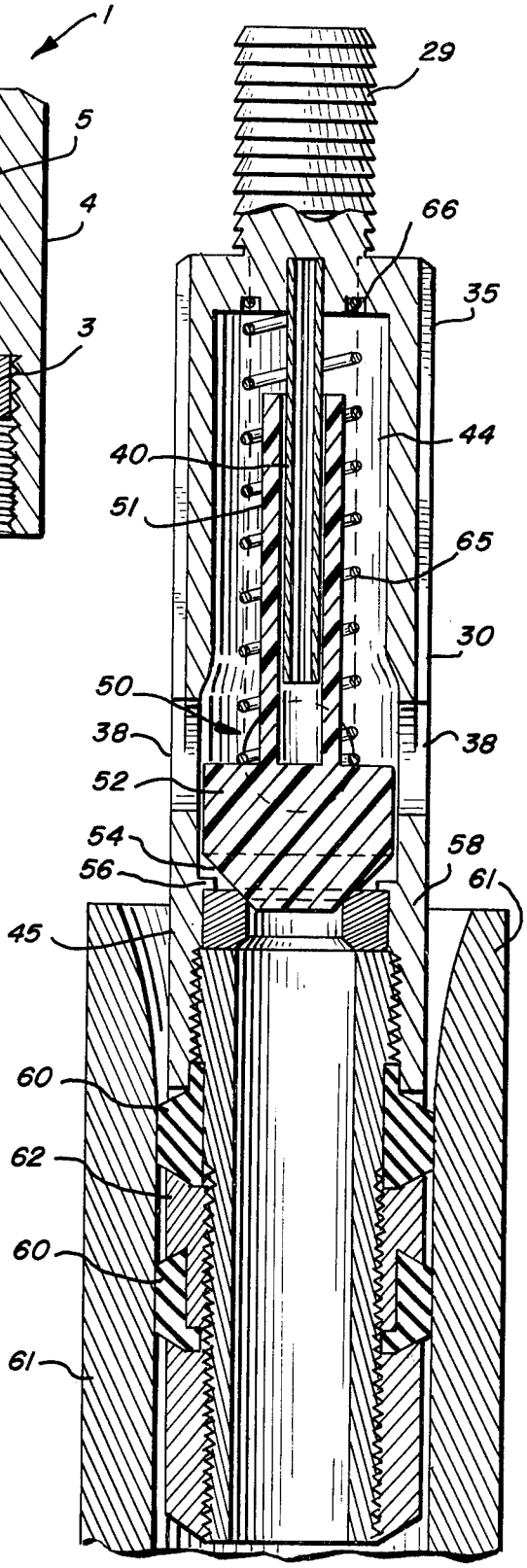
FIG. 3 is an enlarged sectional view of the lower portion of FIG. 1 showing the standing valve configuration illustrative of the present invention.

With the foregoing in mind, the valve illustrative of the present invention as shown in FIG. 3 has a valve body 35 with side fluted passages 36 terminating at their low portion in ports 38. A quiet chamber 44 is defined interiorly of the body 35, and contains the aligning pin 40.

Turning now to FIG. 5, the various parts of the valve are shown in disassembled form. Noting from top to bottom, it will be seen that the valve body 35 has a threaded pin (API standard thread) 39, the depending body portion being generally cylindrical and in its hollow interior having a quiet chamber 44. The fluted fluid passage 36 terminates at its lower portion in three ports 38. The aligning pin 40 has a longitudinal pin slot 41, provided to bypass fluid from the pin bore 42. This configuration is typical of a "roll pin" which can be squeezed slightly, and force fitted into a pin mounting bore 43 (see upper central portion of FIG. 4).

The valve operator 50 has a valve stem 51 with a central aligning pin bore 55 proportioned to slideably receive the aligning pin 40. The valve stem terminates at its lower portion in a valve head 52 which has a lower chamfered seat portion 54. The lower chamfered seat 54 is proportioned to mate with the chamfer 48 in the upper portion of the ring seat 45. The ring seat 45, in turn, has a smooth periphery 46 which engages the interior seat wall 47 of the connector 58 and abutts the ring seat stop 56 (see central portion of FIG. 4).

The connector 58 in the standing valve extends downwardly and mounts the seating cups 60 by means of the seating nipple 61 and cup locks 62 in the conventional fashion.

In the traveling valve configuration of FIGS. 4 and 5, it will be seen that in addition to the connector 58, an extension 59 is employed, both having standard API connector threads 64. From this point it will be readily appreciated that a wide variety of standard attachments may be employed in connection with the valve illustrative of the present invention. These attachments include, of course, the modifications to operate either as a standing valve or a traveling valve, with the balance of the parts interchangeable.

Optionally, a spring 65 may be provided to coaxially bias the head 52 of the valve operator 50 and the upper portion of the quiet chamber 44. This configuration is shown in the standing valve illustrated in FIG. 3. At the upper portion a spring groove 66 may be further provided to orient the spring and prevent the same from cocking and thereby engaging the upper portion of the valve stem 51. To be further noted by the center lines shown in FIG. 3, is the oriented relationship between the interface of the mating chamfers 48, 54 of the valve 50 and the ring seat 45 to direct the passage of fluid out through the ports 38, and inhibit the same from entering the quiet chamber 44.

As mentioned above, the preferred material for forming the operating valve 50 is delrin. This material is inherently stable, resists corrosion, and has a good level of inherent lubricity. The operating valve 50, when removed for service, can be placed into the chuck of a drill, rotated, and the chamfered seat 54 faced with a piece of emery cloth. The valve body 35 is preferably formed of stainless steel, and because there is no pounding against it by a steel ball or equivalent, its lifetime is virtually perpetual.

DESCRIPTION OF SECOND EMBODIMENT

Figure 8:
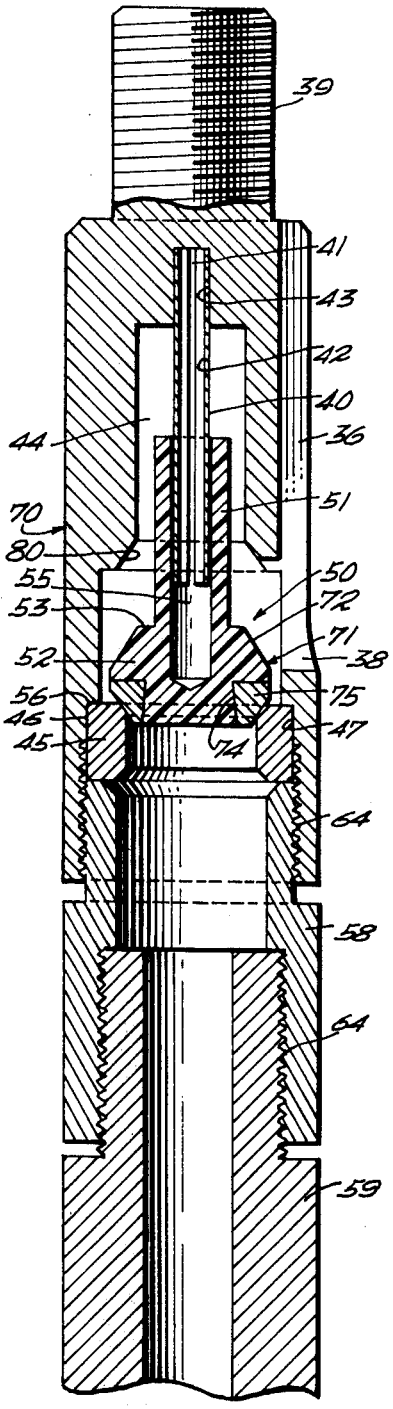
FIG. 8 is a view sectioned and comparable in all common respects to that shown in FIG. 4, but illustrating the alternative embodiment having two seat faces on the valve head 52.
Figure 9:
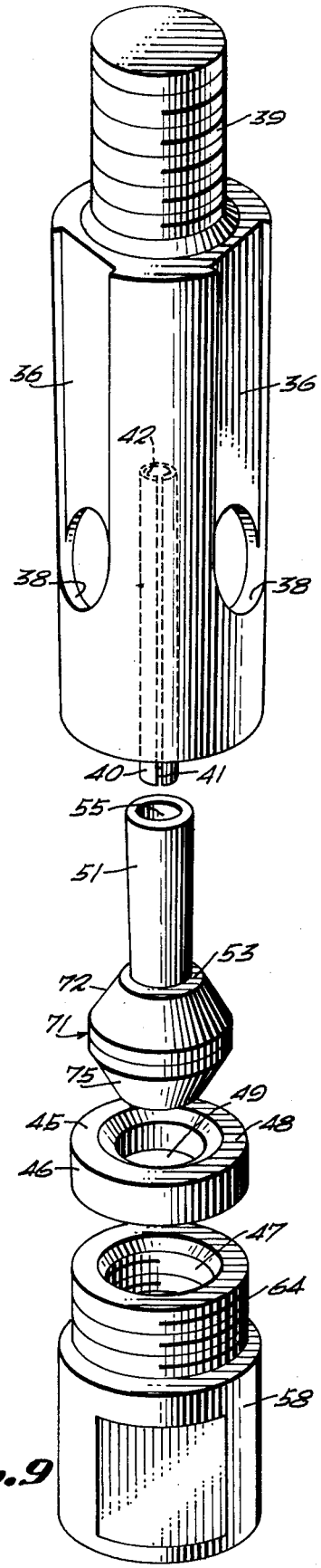
FIG. 9 is an exploded view of the valve operator showing the two seats and a stainless steel insert for the lower seat.

The second embodiment of the subject valve 70 is shown in cross-section in FIG. 8. There it will be seen that common parts are all numbered with the same reference numerals and commonly described with the embodiment shown in FIGS. 3 and 4. The alternative valve operator 71 has the annular shelf 53 substantially eliminated by the upper chamfer seat 72 preferably chambered at an angle of 37° with the axis of the aligning pin bore 55. An undercut collar 74 is provided at the lower portion of the valve head 52 to receive a stainless steel hardened valve seat insert 75. The valve seat inseat is preferably made of No. 416 stainless steel, case hardened to 55–60 Rockwell C with a 30 micro finish maximum. The body of the valve operator 70 is preferably formed of Delrin. The alternative modification in the valve body 35 is primarily directed to a chamfered seat 80 beneath the lower extremity of the quiet chamber 44 to matingly receive and engage the upper seat 72 of the modified valve 70. With the construction of the second embodiment as shown in FIGS. 8 and 9 and as described above, two distinct advantages are achieved:

1. The quiet chamber 44 is sealed off during the time the valve is passing through it through the ports 38. Thus, the turbulence there created does not effect the retained separated reduced oil which is in the quiet chamber 44 and lubricates the relationship between the aligning pin 40 and the pin bore 42.

2. In addition to the guidance given by the aligning pin 40 for the valve 70 on the return stroke to the sealing configuration, the valve is positioned in proper alignment at the upper end of the stroke, so that on the return stroke, it is not only guided at the upper end of the valve stem 51 by the aligning pin 40 but also at the lower end initially by the seated relationship between the upper seat 72 and the seat 80 on the interior portion of the valve body 35.

Just as described with the first embodiment, a spring 65 may alternatively be employed to pre-load the valve 70 into its closed position.

OPERATION

The traveling valve 30 and standing valve 25 illustrative of the present invention are placed in the tubing 11, and reciprocated by means of the rods 12. When the two valves submerge in the fluid, they first contact the oil at the upper portion of the fluid which, in turn, fills the quiet chamber 44. Thus, the first fluid within the quiet chamber 44 is oil, and not the water phase of the produced fluids which contribute to the contamination, gyp, and sand. As the well is pumped, fluids which are a mixture of oil and water pass through the valve, but due to their different specific gravities, the water stays at the lower portion and out through the valve ports, whereas if there is any space in the quiet chamber 44, it will be filled with oil. In the event any particles enter with the fluid stream, they will have a density greater than the specific gravity of the oil in the quiet chamber 44, and thus will settle downwardly and out of the valve. Thus, the aligning pin 40 in its guiding relationship to the stem 51 of the operating valve 50 is protected constantly by this oil within the quiet chamber 44, and contaminants are excluded or expelled.

The positioning of the valve head 52 relative to the discharge ports 38 is such that the annular shelf 53 atop the head 52 is engaged by fluid to close the valve. Also, the valve stem 51 is of a length to insure a minimum opening stroke consistent with closing and good fluid flow through the ports 38. If the head 52 travels too far, it would delay closing on the reverse stroke. If the head 52 does not travel enough, good bypass pumping will not occur. Good results attend the proportions shown where the annular shelf 53, in the closed position is at or below the center of the ports 38, and in the open position the annular shelf 53 is at or above the port 38 center position. Thus, the valve head 52 may travel a distance of approximately ¼ diameter of the ports 38.

Because the valve operator 50 is so light in weight, there is little or no kinetic energy or momentum dissipated as it reciprocates. This not only reduces wear in hammer, but permits instant acceleration in opening of the valve, thereby increasing the capacity and efficiency of the valve in bypassing and sealing fluids. To be understood, of course, is that this valve may be employed as a check valve in various other portions of the producing of fluids, in addition to operating as a standing or traveling valve. One of the great advantages of the provision of the quiet zone or quiet chamber 44 arises from precipitates, described as gyp, which can be calcium carbonate, barium sulphate, and the like are formed wholly within the water phase of the produced fluid. Therefore, they are not deposited on surfaces which they do not contact. Since the quiet chamber 44 is filled with the oil portion, it is inherently free of such precipitates. Theses particular precipitates or contaminants are the most troublesome aspect of the operation of downhole valves and equipment, and thus by being excluded from contact with the operating elements, a long, trouble-free life of the valve operator 50 and its related coacting elements may be predicted. With the embodiment described as the second embodiment and shown in FIGS. 8 and 9 of the drawings, the additional integrity of the quiet chamber is added by means of the upper seat 72 on the second embodiment valve 70 when it is in seated relationship with the valve body quiet chamber seat 80. The advantages are as set forth in the Description of the Second Embodiment.

Although particular embodiments of the invention have been shown and described in full here, there is no intention to thereby limit the invention to the details of such embodiment. On the contrary, the intention is to cover all modifications, alternatives, embodiments, usages and equivalents of a valve as fall within the spirit and scope of the invention, specification and the appended claims.

What is claimed is:

1. A valve comprising, in combination, a valve body, means defining a quiet chamber within the body, port means in the valve body beneath the quiet chamber, an aligning pin extending downwardly into the quiet chamber and secured at its upper portion to the body, a valve havng a stem, a head, and a seating portion on the head, cooperating means coactingly mating the aligning pin and valve stem for sliding coaxial movement, said stem having a thickness smaller than the quiet chamber cross section to define a portion of the quiet chamber surrounding the stem, a seat in the lower portion of the body proportioned to coact in seating engagement with the valve head, the valve head, port means, and seat being proportioned for the valve head to mask a portion of the port means in the closed and open positions, whereby a fluid such as oil entrapped in the quiet chamber will remain entrapped during operation, and the flushing of contaminants passes through the ports away from the quiet chamber.

2. In the valve of claim 1, said valve being formed of an inert plastic material.

said seat being formed of a hard metallic material, whereby the moving part is one of low inertia, and the fixed part will deformingly fashion the seating interface between the valve and the seat.

3. In the valve of claim 1, said aligning pin being hollow and having port means to bypass fluids entrapped in the hollow valve stem into the quiet chamber.

4. In the valve of claim 1, said valve head having a chamfered head, said seat having a chamfered upper portion, both chambers having complementary angularity, the conical trace of which passes through a portion of the port means, whereby outgoing fluids, upon opening of the valve, are directed into the port means.

5. In the valve of claim 1, said valve, head, stem, aligning pin, and body all having a circular cross section, whereby the valve stem may randomly rotate on the aligning pin to clean the same and promote uniformity in the interface between the valve head and seat.

6. In the valve of claim 1, open communication in the closed position between the quiet chamber and the port means, so that when the valve is lowered into a formation having oil on top and water therebeneath, the oil is permitted to penetrate and be entrapped in the quiet chamber to thereby help lubricate and isolate the same from other fluids and contaminants.

7. In the valve of claim 1, means for urging the valve into a closed relationship with the seat, whereby the response of the valve may be varied due to its speed of movement.

8. In the valve of claim 1, spring means biasing the valve head and upper portion of the body within the quiet chamber, thereby permitting a variation of the response of the valve to the speed and movement thereof.

9. In the valve of claim 1, said valve being formed of delrin and the seat of hardened steel.

10. In the valve of claim 1, said aligning means being hollow and having a longitudinal slot for relieving fluids entrapped within the hollow stem of the valve.

11. In the valve of claim 1, a fluted fluid passageway extending upwardly along the body from the port means.

12. In the valve of claim 1, said port means being circular holes, the unchamfered thickness of the head being less than the diameter of the port holes the dimensions of the stem, aligning pin, and head being proportioned and oriented to permit bypass of fluids into the quiet zone while closed and inhibit the same when the valve is in the open position.

13. A valve comprising, in combination, a valve body, means defining a cylindrical quiet chamber within the body, port means in the valve body beneath the quiet chamber, an aligning pin extending downwardly into the quiet chamber and secured at its upper portion to the body, a valve having a stem, a head, and a valve seating portion at the lower portion on the head, and a quiet chamber seating portion at the upper portion of the head, the diameter of the valve stem being less than that of the quiet chamber to define an annular portion of the quiet chamber thereabout, cooperating means coactingly mating the aligning pin and valve stem for sliding coaxial movement, a seat in the lower portin of the body proportional to coact in seating engagement with the valve head, a seat in the mid-portion of the body at the lower extemity of the quiet chamber for mating engagement with the quiet chamber seat on the valve head, the valve head, port means, and seat being proportioned for the valve head to mask a portion of the port means in the closed and open positons, whereby a fluid such as oil entrapped in the quiet chamber will remain entrapped during operation, and the flushing of contaminants passes through the ports away from the quiet chamber.

14. In the valve of claim 13, said valve being formed of an inert plastic material, said seat being formed of a hard metallic material, whereby the moving part is one of lower inertia, and the fixed part will deformingly fashion the seating interface between the valve and the seat.

15. In the valve of claim 13, said aligning pin being hollow and having port means to bypass fluids entrapped in the hollow valve stem into the quiet chamber.

16. In the valve of claim 13, said valve head having a chamfered head, said seat having a chamfered upper portion, both chamfers havng complementary angularity, the conical trace of which passes through a portion of the port means, whereby outgoing fluids, upon opening of the valve, are directed into the port means.

17. In the valve of claim 13, means for urging the valve into a closed relationship with the seat, whereby the response of the valve may be varied due to its speed of movement.

18. In the valve of claim 13, spring means biasing the valve head and upper portion of the body within the quiet chamber, thereby permitting a variation of the response of the valve to the speed and movement thereof.

19. In the valve of claim 13, said port means being circular holes, the unchamfered thickness of the head being less than the diameter of the port holes the dimensions of the stem, aligning pin, and head being proportioned and oriented to permit bypass of fluids into the quiet zne while closed and inhibit the same when the valve is in the open position.

20. In the valve of claim 13, said seat having a hardened metal insert snap fittingly engaging the same to provide a metal to metal contact at the seal when fluid is not being passed through the port.

* * * * *